US011014367B2

(12) United States Patent
Fukasawa

(10) Patent No.: US 11,014,367 B2
(45) Date of Patent: May 25, 2021

(54) INKJET PRINTER AND INK SUPPLY UNIT

(71) Applicant: SEIKO EPSON CORPORATION, Tokyo (JP)

(72) Inventor: Koki Fukasawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 15 days.

(21) Appl. No.: 16/725,136

(22) Filed: Dec. 23, 2019

(65) Prior Publication Data

US 2020/0207102 A1 Jul. 2, 2020

(30) Foreign Application Priority Data

Dec. 26, 2018 (JP) ..... JP2018-242247

(51) Int. Cl.
*B41J 2/175* (2006.01)
*B41J 11/70* (2006.01)

(52) U.S. Cl.
CPC ..... *B41J 2/17503* (2013.01); *B41J 11/70* (2013.01)

(58) Field of Classification Search
CPC .... B41J 11/70; B41J 2/17503; B41J 2/17523; B41J 2/175; B41J 2/01
See application file for complete search history.

(56) References Cited

U.S. PATENT DOCUMENTS

2015/0054890 A1* 2/2015 Takeuchi ..... B41J 29/02 347/85

FOREIGN PATENT DOCUMENTS

JP 2010131893 6/2010
JP 2013198992 10/2013

OTHER PUBLICATIONS

IP.com search (Year: 2021).*

* cited by examiner

*Primary Examiner* — Lisa Solomon
(74) *Attorney, Agent, or Firm* — Workman Nydegger

(57) ABSTRACT

An inkjet printer includes a housing, a first ink tank provided outside the housing, the first ink tank configured to store ink, a carriage having a second ink tank provided inside the housing, the second ink tank configured to store the ink, and a tube bundle obtained by bundling a plurality of tubes by which the second ink tank and the first ink tank are coupled. The housing is provided with a paper exit through which a sheet in the housing passes, the tube bundle passes through the paper exit, and a tube alignment direction of the tube bundle at the paper exit intersects with a sheet surface normal direction of the sheet at the paper exit.

9 Claims, 9 Drawing Sheets

INKJET PRINTER AND INK SUPPLY UNIT

The present application is based on, and claims priority from JP Application Serial Number 2018-242247, filed Dec. 26, 2018, the disclosure of which is hereby incorporated by reference herein in its entirety.

BACKGROUND

The present disclosure relates to an inkjet printer and an ink supply unit.

Typically, as described in JP-A-2013-198992, an inkjet recording device is known which includes a recording head and an ink accommodating unit provided outside a housing of the inkjet recording device. Further, the inkjet recording device includes a tube configured to guide ink in the ink accommodating unit to a recording head, and the tube couples the ink accommodating unit and the recording head via a notch provided on a side wall of the housing.

SUMMARY

However, in the above inkjet recording device, there is a problem in that a space for routing the tube is increased in size due to a position of the notch through which the tube is passed and a position where the ink accommodating unit is disposed.

An inkjet printer of the present application includes a housing, a first ink tank provided outside the housing, the first ink tank configured to store ink, a carriage having a second ink tank provided inside the housing, the second ink tank configured to store the ink, and a tube bundle obtained by bundling a plurality of tubes by which the second ink tank and the first ink tank are coupled, wherein the housing is provided with a paper exit through which a sheet in the housing passes, the tube bundle passes through the paper exit, and a tube alignment direction of the tube bundle at the paper exit intersects with a sheet surface normal direction of the sheet at the paper exit.

An ink supply unit is an ink supply unit for supplying ink to a second ink tank of an inkjet printer including a housing, a carriage having the second ink tank provided inside the housing, and a paper exit provided in the housing, where a sheet in the housing passes through the paper exit. The ink supply unit includes a first ink tank provided outside the housing, the first ink tank configured to store ink, and a tube bundle obtained by bundling a plurality of tubes by which the second ink tank and the first ink tank are coupled, wherein the tube bundle passes through the paper exit, and a tube alignment direction of the tube bundle at the paper exit intersects with a sheet surface normal direction of the sheet at the paper exit.

DESCRIPTION OF EXEMPLARY EMBODIMENTS

Exemplary embodiments of the present disclosure will be described below with reference to the accompanying drawings. Note that, in each of the figures below, to illustrate each of members and the like in a recognizable size, each of the members and the like is illustrated to a scale different from an actual scale.

1. First Embodiment

Figure 1:
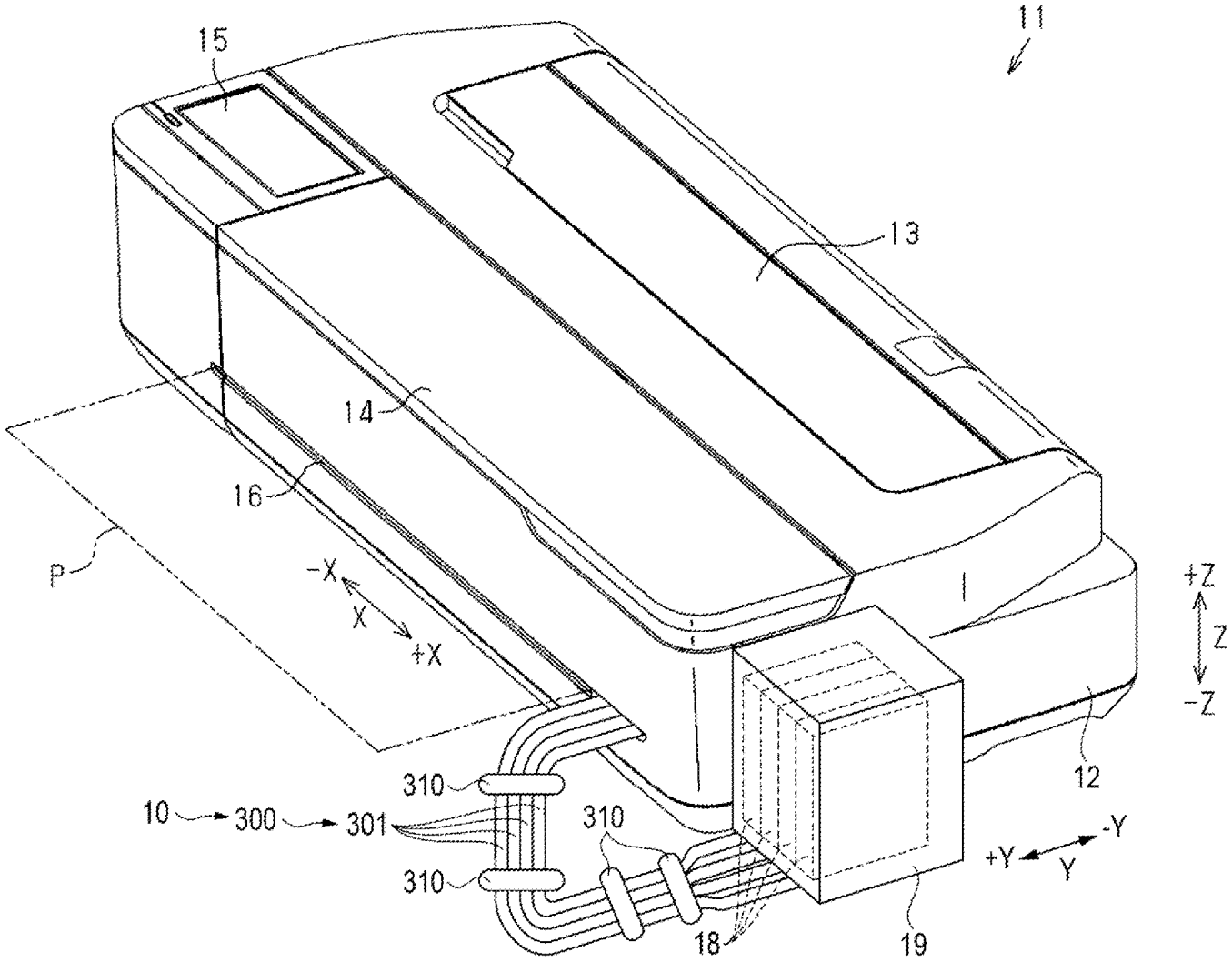
FIG. 1 is an outer perspective view illustrating a configuration of an inkjet printer according to a first embodiment.
Figure 2:
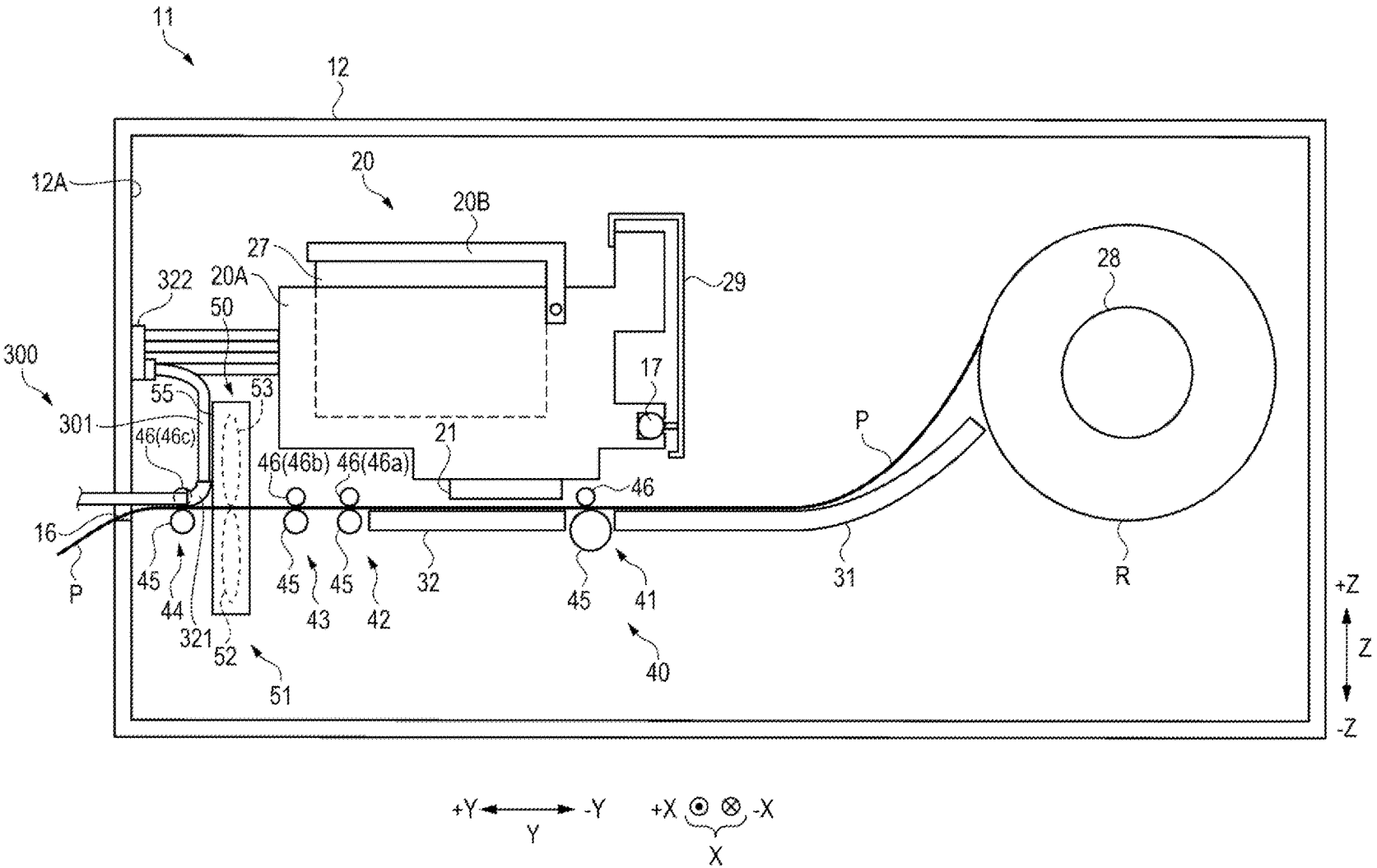
FIG. 2 is a lateral side view illustrating an internal configuration of the inkjet printer according to the first embodiment.

FIG. 1 is an outer perspective view illustrating a configuration of an inkjet printer 11. FIG. 2 is a lateral side view illustrating an internal configuration of the inkjet printer 11.

In the following description, the inkjet printer 11 illustrated in FIG. 1 is placed on a horizontal surface, an axis along the upward and downward directions is illustrated as a Z axis and axes along the horizontal surface are illustrated as an X axis and a Y axis. That is, when the inkjet printer 11 is viewed from the front, the X axis along a width direction of the inkjet printer 11, the Y axis along a depth direction thereof, and the Z axis along a height direction thereof have different directions and are orthogonal to one another.

As illustrated in FIG. 1, the inkjet printer 11 includes a housing 12 having a substantially rectangular parallelepiped form. On a top surface, which is a surface on a +Z direction side of the housing 12, a sheet feed cover 13 located on a −Y direction side of the housing and a maintenance cover 14 located on a +Y direction side thereof are provided, and the both components can be opened and closed. In a −X direction of the maintenance cover 14 on the top surface of the housing 12, an operation panel 15 for performing various operations of the inkjet printer 11 is provided. Furthermore, on a front surface, which is a side surface on the +Y direction side in the housing 12, a paper exit 16 is arranged which allows a sheet P, which is an example of a medium printed in the housing 12, to pass toward the +Y direction. In the embodiment, a direction running from the −Y direction side to the +Y direction side is a paper discharge direction of the sheet P.

Furthermore, a tank accommodating unit 19 is provided outside the housing 12. The tank accommodating unit 19 accommodates an ink tank 18 serving as a first ink tank configuring a part of the ink supply unit 10. In the embodiment, the tank accommodating unit 19 is disposed on the side surface on a +X direction side of the housing 12. The inkjet printer 11 in the embodiment is a so-called off-carriage type printer.

The tank accommodating unit 19 has a substantially rectangular parallelepiped form and is fixed to the housing 12 by screws, bolts, or the like. The ink tank 18 is accommodated in the tank accommodating unit 19. In the embodiment, the ink tank 18 includes a plurality of ink tanks 18, and these ink tanks 18 are accommodated in the tank accommodating unit 19. FIG. 1 illustrates a state in which four ink tanks 18 are accommodated in the tank accommodating unit 19. Each of the ink tanks 18 is a container capable of storing ink. A configuration that each of the ink tanks 18 stores a different type of ink, a configuration that all the ink tanks 18 store the same type of ink, or a configuration that some ink tanks 18 of the plurality of ink tanks 18 store the same type of ink and the others store different types of ink may be employed.

An example of the type of ink includes ink color. For example, a configuration that the plurality of ink tanks 18 store colors of ink different from each other, a configuration that all the ink tanks 18 store the same color of ink, or a configuration that some ink tanks 18 of the plurality of ink tanks 18 store the same color of ink and the others store different colors of ink, may be employed. Examples of the color of ink include black, yellow, magenta, and cyan. Furthermore, examples of the different types of inks also include inks with dyes and inks with pigments.

One end of a tube 301 configuring a part of the ink supply unit 10 is coupled to the ink tank 18. The other end of the tube 301 is coupled to an ink storage unit 27 serving as a second ink tank corresponding to the ink tank 18 to which one end of the tube 301 is coupled. The ink storage unit 27, which includes a plurality of ink storage units 27, is provided in the housing 12. In the embodiment, the tube 301 includes a plurality of tubes 301, and each of the ink tanks 18 and each of the ink storage units 27 are coupled by four of the tubes 301. The tube 301 is a flexible tube member. In the embodiment, a tube bundle 300 obtained by bundling the plurality of tubes 301 are routed. A clamp member 310 is used as a means for bundling the plurality of tubes 301. The clamp member 310, which includes a plurality of clamp members 310, is a holding member capable of binding the plurality of tubes 301. The tube bundle 300 is bundled by the clamp members 310 at a plurality of locations.

The ink stored in the ink storage unit 27 is supplied to an inkjet head 21 serving as an ejection unit, and the ink is ejected from the inkjet head 21.

Further, the ink tank 18 includes an ink inlet conduit (not illustrated). When an ink refilling bottle accommodating a refilling ink is then inserted into the ink inlet conduit, the ink tank 18 is refilled with the ink.

As illustrated in FIG. 2, a roll body R in which the sheet P is wound in a roll shape is disposed in the housing 12. The roll body R is disposed on the −Y direction side in the housing 12 in FIG. 2. The roll body R is rotatably supported by a shaft 28 extending along the X axis. In the embodiment, the sheet P is conveyed out from the roll body R by rotating the shaft 28 in a counterclockwise direction in FIG. 2. The conveyed out sheet P is transported by a transport unit 40 and is discharged from the housing 12 to the outside of the housing 12 through the paper exit 16 opening to an end in a +Y direction of the housing 12. In the embodiment, a path along which the conveyed out sheet P is transported to the paper exit 16 by the transport unit 40 is a transport path, and a direction from the −Y direction side to the +Y direction side of the housing 12 is a transport direction of the sheet P transported by the transport unit 40.

A carriage 20 is provided in the housing 12. The ink storage unit 27 and the inkjet head 21 are provided in the carriage 20. The carriage 20 is supported by a frame member 29 and a guide shaft 17 attached to the frame member 29. The guide shaft 17 extends in a width direction of the sheet P. In the embodiment, the width direction of the sheet P is a direction along the X axis. The carriage 20 is movable along the guide shaft 17 by a drive source such as a motor (not illustrated). That is, the carriage 20 is movable along the X axis.

The ink storage unit 27 is a container for storing ink, and is a sub-tank for storing the ink supplied from the ink tank 18 via the tube 301. The ink stored in the ink storage unit 27 is supplied to the inkjet head 21. In the carriage 20, the ink storage unit 27 is disposed at a position in a +Z direction relative to the inkjet head 21. The carriage 20 includes a main body 20A in which the ink storage unit 27 can be accommodated, and a cover 20B configured to cover the ink storage unit 27 accommodated in the main body 20A from above, that is, from the +Z direction.

The inkjet head 21 includes a plurality of nozzles (not illustrated). Further, the inkjet head 21 is provided with an actuator (not illustrated) corresponding to each of the nozzles, and can eject the ink from each of the nozzles by driving the actuator. For example, a piezoelectric element can be employed as the actuator.

Then, when the carriage 20 reciprocates along the X axis, the inkjet head 21 can eject the ink across an entire width direction of the sheet P.

Along the transport path of the sheet P, a first support member 31 and a second support member 32 are disposed. The first support member 31 and the second support member 32 are configured by plate-like members. The first support member 31 is disposed upstream from the second support member 32 in the transport direction, and guides the sheet P conveyed out from the roll body R toward the inkjet head 21. The second support member 32 is disposed to face the inkjet head 21.

The transport unit 40 transports the sheet P conveyed out from the roll body R toward the paper exit 16 to run along the first support member 31 and second support members 32. The transport unit 40 includes a first transport roller pair 41, a second transport roller pair 42, a third transport roller pair 43, and a fourth transport roller pair 44, in this order, from upstream position to downstream position in the transport direction. The first transport roller pair 41 is disposed upstream from the inkjet head 21 in the transport direction, and is disposed between the first support member 31 and the second support member 32. The second transport roller pair 42, the third transport roller pair 43, and the fourth transport roller pair 44 are disposed downstream from the inkjet head 21 and upstream from the paper exit 16 in the transport direction.

The first transport roller pair 41 includes a driving roller 45 which can drive and rotate by a motor (not illustrated), and a driven roller 46 which can be driven and rotated by the rotation of the driving roller 45. When the driving roller 45 is rotated while the driving roller 45 and the driven roller 46 sandwich the sheet P, the sheet P is transported by the first transport roller pair 41. The driving roller 45 is configured to contact the sheet P from below (−Z direction side). The driven roller 46 is configured to contact the sheet P from above (+Z direction side). That is, the driven roller 46 is configured to contact a surface of the sheet P onto which the ink is ejected. The second transport roller pair 42, the third transport roller pair 43, and the fourth transport roller pair 44 include the driving roller 45 and the driven roller 46, similarly to the first transport roller pair 41. In the description that follows, for clarity, the driven roller 46 provided in the first transport roller pair 41 will be referred to as a driven roller 46*a*, the driven roller 46 provided in the second transport roller pair 42 will be referred to as a driven roller 46*b*, the driven roller 46 provided in the third transport roller pair 43 will be referred to as a driven roller 46*c*, and the driven roller 46 provided in the fourth transport roller pair 44 will be referred to as a driven roller 46*d*. Therefore, when transporting the sheet P, the driven rollers 46*b*, 46*c*, and 46*d* contact the surface onto which the ink is ejected. Accordingly, the driven rollers 46 in the second transport roller pair 42, the third transport roller pair 43, and the fourth transport roller pair 44 are configured by a star wheel and the like having a small contact area with respect to the sheet P in order to reduce deterioration of the quality of the image recorded in the sheet P. The first transport roller pair 41, the second transport roller pair 42, the third transport roller pair 43, and the fourth transport roller pair 44 are each configured by a plurality of rollers disposed at predetermined intervals in the width direction.

Note that in the embodiment, each of the driven rollers 46*b*, 46*c*, and 46*d* corresponds to a sheet ejecting roller.

A cutting unit 50 is provided in the housing 12. The cutting unit 50 is to cut the sheet P. The cutting unit 50 is provided between the paper exit 16 and the inkjet head 21 in the transport direction. That is, the cutting unit 50 cuts the sheet P between the paper exit 16 and the inkjet head 21 in the transport direction. In the embodiment, the cutting unit 50 is disposed between the third transport roller pair 43 and the fourth transport roller pair 44.

The cutting unit 50 includes a cutting blade 51 configured to cut the sheet P and a holding body 55 configured to hold the cutting blade 51. The cutting blade 51 is configured by a driving blade 52 and a driven blade 53 both of which have a disk-like shape. The driving blade 52 and the driven blade 53 are rotatably attached to the holding body 55. The driving blade 52 and the driven blade 53 are disposed to be aligned along the Z axis. The holding body 55 is capable of reciprocating along the X axis. The cutting unit 50 cuts the sheet P by the cutting blade 51 when the holding body 55 moves along the X axis. That is, the cutting unit 50 including the cutting blade 51 cuts the sheet P by scanning the sheet P along the X axis that intersects the transport direction of the sheet P. The cutting unit 50 waits at a position of an end in the −X direction in the housing 12, and is reciprocably movable along the X axis by a driving force transmitted from a drive source such as a motor (not illustrated). Note that, as a moving means of the cutting unit 50, while being coupled to the carriage 20, the cutting unit 50 may be moved reciprocably along the X axis by a driving force of a motor for moving the carriage 20.

The sheet P cut by the cutting unit 50 is discharged from the paper exit 16 by the fourth transport roller pair 44 disposed between the paper exit 16 and the cutting unit 50. Note that in the inkjet printer 11 according to the embodiment, the paper exit 16 has a relatively small dimension in the vertical direction Z so that fingers of a user cannot be inserted into the housing 12 from the paper exit 16. Therefore, when the fourth transport roller pair 44 is disposed near upstream of the paper exit 16, the sheet P can be smoothly transported toward the paper exit 16 having a small dimension in the vertical direction Z to prevent sheet jam from occurring.

Figure 3:
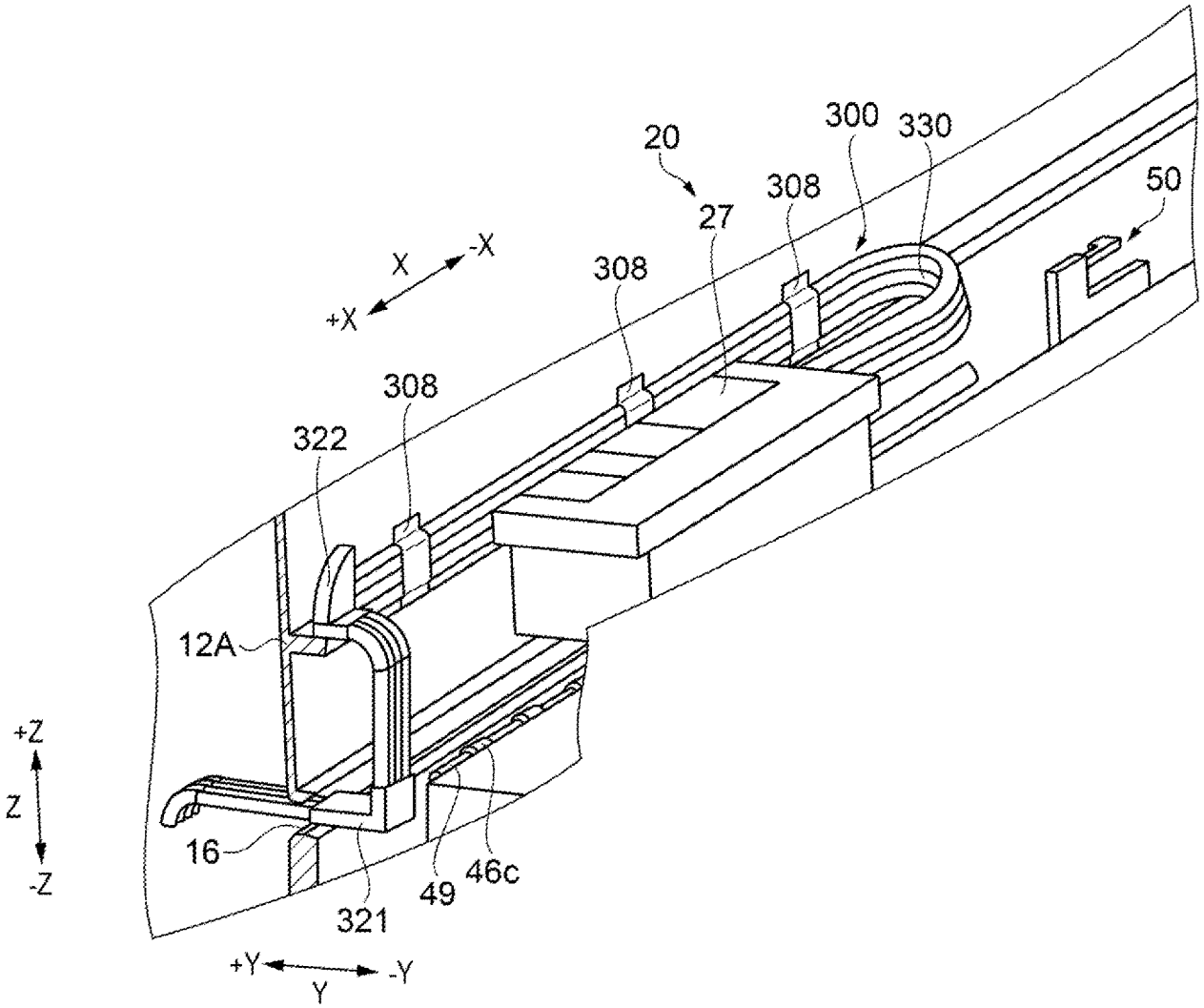
FIG. 3 is a partial perspective view illustrating an internal configuration of the inkjet printer according to the first embodiment.
Figure 4:
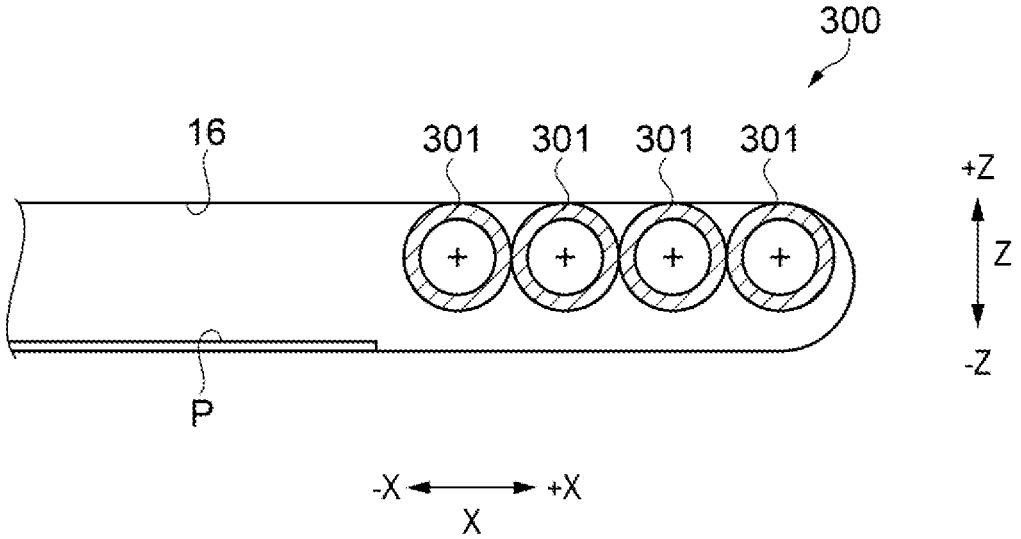
FIG. 4 is an explanatory diagram illustrating a tube alignment direction of a tube bundle at a paper exit according to the first embodiment.

Next, a manner for routing the tube 301 will be described. FIG. 3 is a partial perspective view illustrating an internal configuration of the inkjet printer 11. FIG. 4 is an explanatory diagram illustrating a tube alignment direction of the tube bundle 300 at the paper exit 16, and is a front view illustrating the housing 12 as viewed from the +Y direction.

As illustrated in FIG. 1 to FIG. 3, the four tubes 301 coupled to the ink tank 18 provided outside the housing 12 are configured as one tube bundle 300. The tube bundle 300 is held by the clamp member 310 while the four tubes 301 are bundled to be juxtaposed and form one line. The tube bundle 300 is inserted from the paper exit 16 into the housing 12. That is, the tube bundle 300 passes through the paper exit 16 when the tube bundle 300 is between the outside of the housing 12 and the inside of the housing 12. The tube alignment direction of the tube bundle 300 at the paper exit 16 intersects with a sheet surface normal direction of the sheet P at the paper exit 16.

Here, as illustrated in FIG. 4, as for the tube alignment direction of the tube bundle 300 at the paper exit 16, if all the tubes 301 included in the tube bundle 300 are present on a straight line linking centers of the two most distant tubes, in a cross section of all the tubes 301 included in the tube bundle 300, an extension direction of the straight line is the tube alignment direction of the tube bundle 300.

The tube bundle 300 is disposed so that the tube alignment direction of the tube bundle 300 at the paper exit 16 is substantially parallel to the plane of the sheet P. In this way, an opening of the paper exit 16 need not be further enlarged so that the tube bundle 300 passes through the opening. As a result, it is possible to prevent a foreign material from entering due to the expansion of the paper exit 16. Further, it is possible to use the paper exit 16 as an insertion port for the tube bundle 300.

In addition, at the paper exit 16, the tube bundle 300 may be disposed so that an end on the +Z direction side of each of the tubes 301 included in the tube bundle 300 and an end on the +Z direction side of the paper exit 16 come into contact with each other. In this way, at the paper exit 16, when a dimension in a Z-axis direction of the tube bundle 300 is smaller than a dimension in a Z-axis direction of the paper exit 16, a gap is formed between an end on the −Z direction side of the tube 301 and an end on the −Z direction side of the paper exit 16 to prevent interference between the sheet P and the tube 301 to secure a transportability for the sheet P.

In addition, the tube bundle 300 may be disposed so that the tube 301 disposed at an end on the +X direction side, of the tube bundle 300, at the paper exit 16 is located at an end on the +X direction side of the paper exit 16. In this way, the tube bundle 300 is located at the end on the +X direction side of the paper exit 16 so that it is possible to prevent interference between the sheet P and the tube 301 to secure the transportability for the sheet P.

As illustrated in FIG. 2 and FIG. 3, the tube bundle 300 inserted into the housing 12 from the outside of the housing 12 via the paper exit 16 passes through a position where the driven roller 46*d* included in the fourth transport roller pair 44 is not present. Specifically, the roller shaft 49 on which the driven roller 46*d* is disposed extends along the X axis, but the sheet P does not pass at a position corresponding to the end in the +X direction of the paper exit 16, and thus, the driven roller 46*d* is not provided at that position. Accordingly, the tube bundle 300 inserted from the paper exit 16 is less likely to interfere with the driven roller 46*c*, so that the tube bundle 300 can be easily inserted into the housing 12.

Note that the driven roller 46*b* corresponds to a first sheet ejecting roller, and the driven roller 46*c* corresponds to a second sheet ejecting roller.

Further, the tube bundle 300 inserted into the housing 12 passes between the driven roller 46*b* included in the third transport roller pair 43 and a frame 12A including the paper exit 16. The frame 12A is a wall configuring a front surface of the housing 12. Upward lifting of the sheet P transported by the driven rollers 46*b* and 46*c* is suppressed, and thus, interference between the tube bundle 300 and the sheet P is prevented, the tube bundle 300 can be efficiently routed, and the sheet P can be smoothly transported.

In addition, as illustrated in FIG. 3, a portion on an ink storage unit 27 side from the paper exit 16, out of the tube bundle 300 inserted into the housing 12, is fixed to the frame 12A in which the paper exit 16 is provided. That is, a portion of the tube bundle 300 inserted into housing 12 is fixed to the frame 12A. In further detail, the tube bundle 300 is fixed to the frame 12A so that the tube alignment direction of the tube bundle 300 runs along the Z axis. That is, the tube bundle 300 is fixed so that the tube alignment direction of the tube bundle 300 is parallel to the plane of the frame 12A. An adhesive tape 308 can be applied as a fixing means for fixing the tube bundle 300 to the plane of the frame 12A. The adhesive tape 308 includes a plurality of adhesive tapes 308, and the tube bundle 300 is fixed with the adhesive tapes 308 at a plurality of locations while the tube bundle 300 is abutted against the frame 12A. With such a configuration, a space for fixing the tube bundle 300 to the frame 12A can be minimized. In addition, it is possible to prevent the tube bundle 300 from sagging. Thus, the interference between the tube bundle 300 and the cutting unit 50 can be suppressed. In addition, the interference between the tube bundle 300 and the sheet P can be suppressed.

In addition, in the embodiment, each of the tubes 301 included in the tube bundle 300 is coupled via a first coupling portion 321 and a second coupling portion 322. The first coupling portion 321 and the second coupling portion 322A include a tube portion corresponding to each of the tubes 301. In the embodiment, four tube portions are formed in each of the first coupling portion 321 and the second coupling portion 322.

The first coupling portion 321 is disposed between the paper exit 16 and the driven roller 46*c*. The first coupling portion 321 includes a bent portion which is used to redirect a direction in which the tube 301 inserted into the housing 12 from the paper exit 16 along the Y axis extends, into the +Z direction.

The second coupling portion 322 is disposed between the first coupling portion 321 and the ink storage unit 27. In addition, the second coupling portion 322 is disposed to be fixed to the frame 12A. The second coupling portion 322 includes a bent portion which is used to redirect a direction in which the tube 301 routed from the first coupling portion 321 along the +Z direction extends, into the −X direction.

The tubes 301 included in the tube bundle 300 have elasticity, and thus, if the direction in which the tube 301 extends is redirected while a member such as the first coupling portion 321 and the second coupling portion 322 is not employed, the tube 301 is sagged, and as a result, a space for routing the tube bundle 300 may be possibly expanded. If the first coupling portion 321 and the second coupling portion 322 are employed, it is possible to prevent the expansion of the space for routing the tube bundle 300.

As illustrated in FIG. 3, the tube bundle 300 inserted from the paper exit 16 forms a curved portion 330, which is a curved portion, in the housing 12, and is coupled to the ink storage unit 27 via the curved portion 330. The curved portion 330 moves along with the movement of the carriage 20. Here, the tube alignment direction of the tube bundle 300 in the curved portion 330 intersects with a sheet surface of the sheet P at the paper exit 16.

Here, as for the tube alignment direction of the tube bundle 300 at the curved portion 330, if all the tubes 301 are present on a straight line linking centers of the two most distant tubes, in a cross section orthogonal to an extending direction of the tubes 301 included in the tube bundle 300 in the curved portion 330, the extension direction of the straight line is the tube alignment direction of the tube bundle 300. In the embodiment, the tube alignment direction of the tube bundle 300 in the curved portion 330 is a direction substantially along the Z axis and is a direction along the Z axis substantially orthogonal to a XY plane of the sheet surface of the sheet P. In this way, it is possible to efficiently route the tube bundle 300 in a narrow space between the paper exit 16 and the carriage 20.

According to the present embodiments, the following advantages can be obtained. The tube bundle 300 couples the ink tank 18 and the ink storage unit 27 via the paper exit 16. When the paper exit 16 through which the sheet P is passed is used also as a routing path of the tube bundle 300, it is possible to eliminate a need to separately provide a routing path for the tube bundle 300 in the housing 12. Accordingly, it is possible to suppress expansion of the space for routing the tube bundle 300 from the ink tank 18 provided outside the housing 12 into the housing 12. In addition, when an opening is provided in the housing 12, particularly, in a surface other than a surface on the +Y direction side where the paper exit 16 is provided and the tube bundle 300 is disposed in a path passing through the opening, a condition for installing the inkjet printer 11 may be less adaptable. For example, there is an example where in place of an inkjet printer including an ink cartridge and not requiring the space for routing the tube bundle 300, the inkjet printer 11 of the embodiment is installed. In this example, in a case where the inkjet printer 11 is installed in a shelf with a plate surface therearound, a gap between the surface of the housing 12 and the plate surface that is otherwise unnecessary for typical inkjet printers is newly required because of the space for routing the tube bundle 300. However, usually, the inkjet printer has a paper exit, and even in typical inkjet printers, a space in which a sheet discharged from the paper exit is present is required, and thus, when the space is utilized as the space for routing the tube bundle 300, a condition for installing the inkjet printer 11 of the embodiment is likely to be adaptable than typical inkjet printers.

Furthermore, the tube bundle 300 is inserted from the paper exit 16 while the tube bundle 300 is intersecting the sheet surface normal direction of the sheet P at the paper exit 16. This eliminates a need to enlarge the paper exit 16 in the sheet surface normal direction of the sheet P at the paper exit 16, and thus, an opening area of the paper exit 16 is suppressed, and it is possible to prevent a foreign material from entering from the paper exit 16 into the housing 12.

Note that in the inkjet printer 11 of the embodiment, the tank accommodating unit 19 accommodating the ink tank 18 is disposed on the side surface in the +X direction of the housing 12, but this is not limiting. For example, the tank accommodating unit 19 may be disposed on a front surface in the +Y direction of the housing 12 and may also be disposed on a top surface of the housing 12 in the +Z direction. In this case as well, the tube bundle 300 is insertable into the housing 12 from the paper exit 16, which makes it possible to further improve the freedom degree of the routing of the tube bundle 300 and to suppress the expansion of the routing space. Furthermore, a space for installing the inkjet printer 11 can be effectively utilized.

2. Second Embodiment

Figure 5:
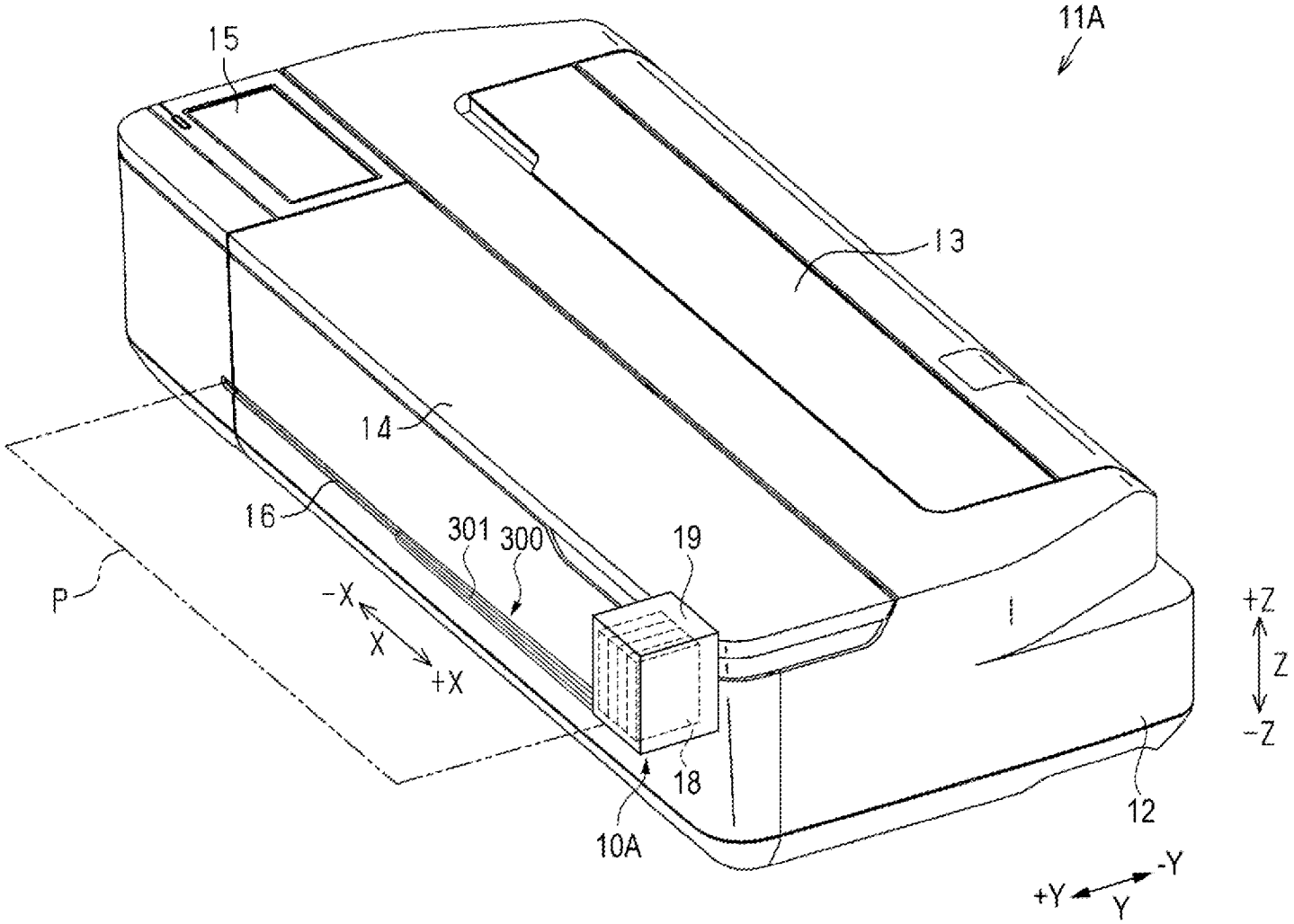
FIG. 5 is an outer perspective view illustrating a configuration of an inkjet printer according to a second embodiment.
Figure 6:
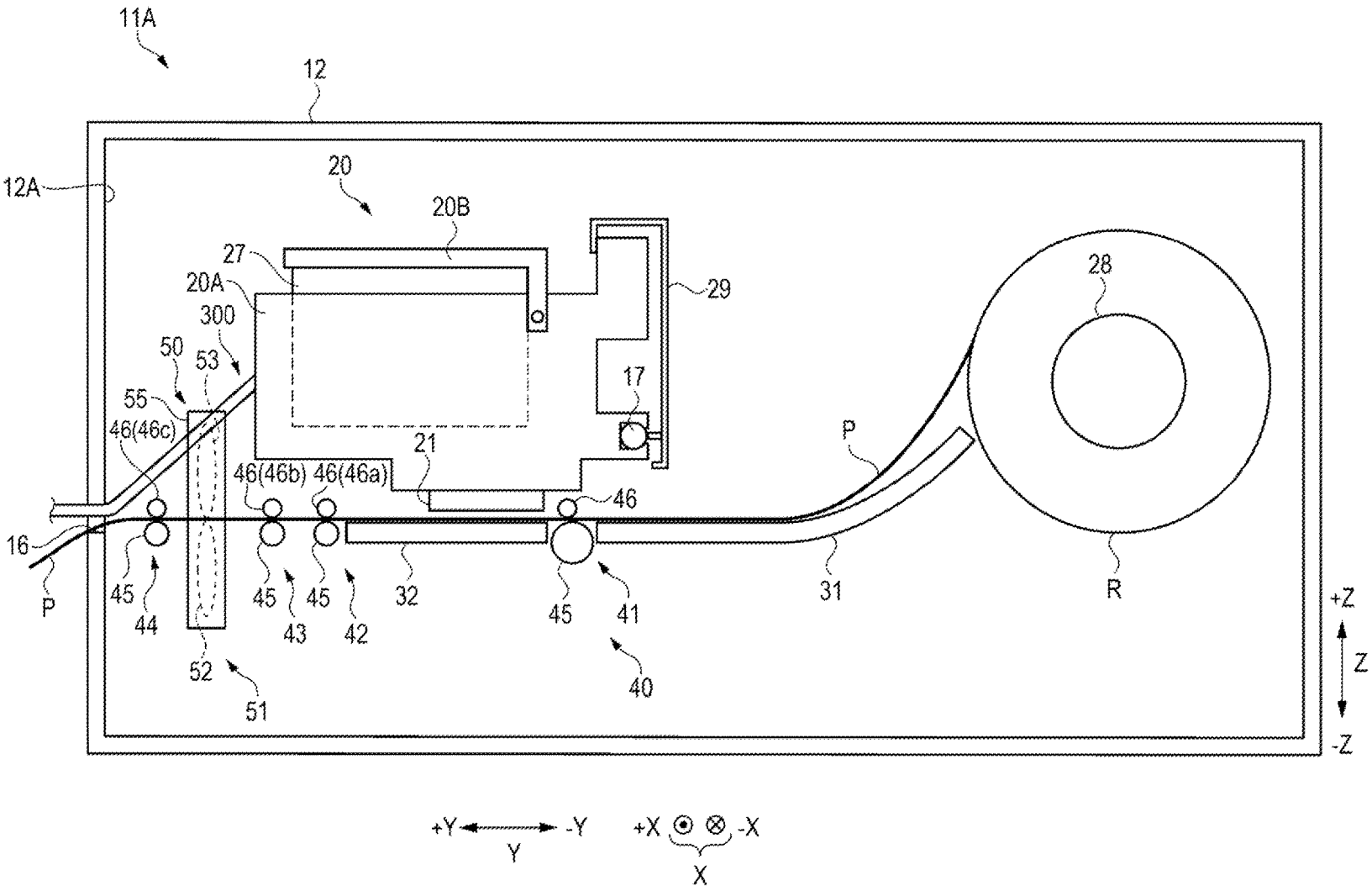
FIG. 6 is a lateral side view illustrating an internal configuration of the inkjet printer according to the second embodiment.
Figure 7:
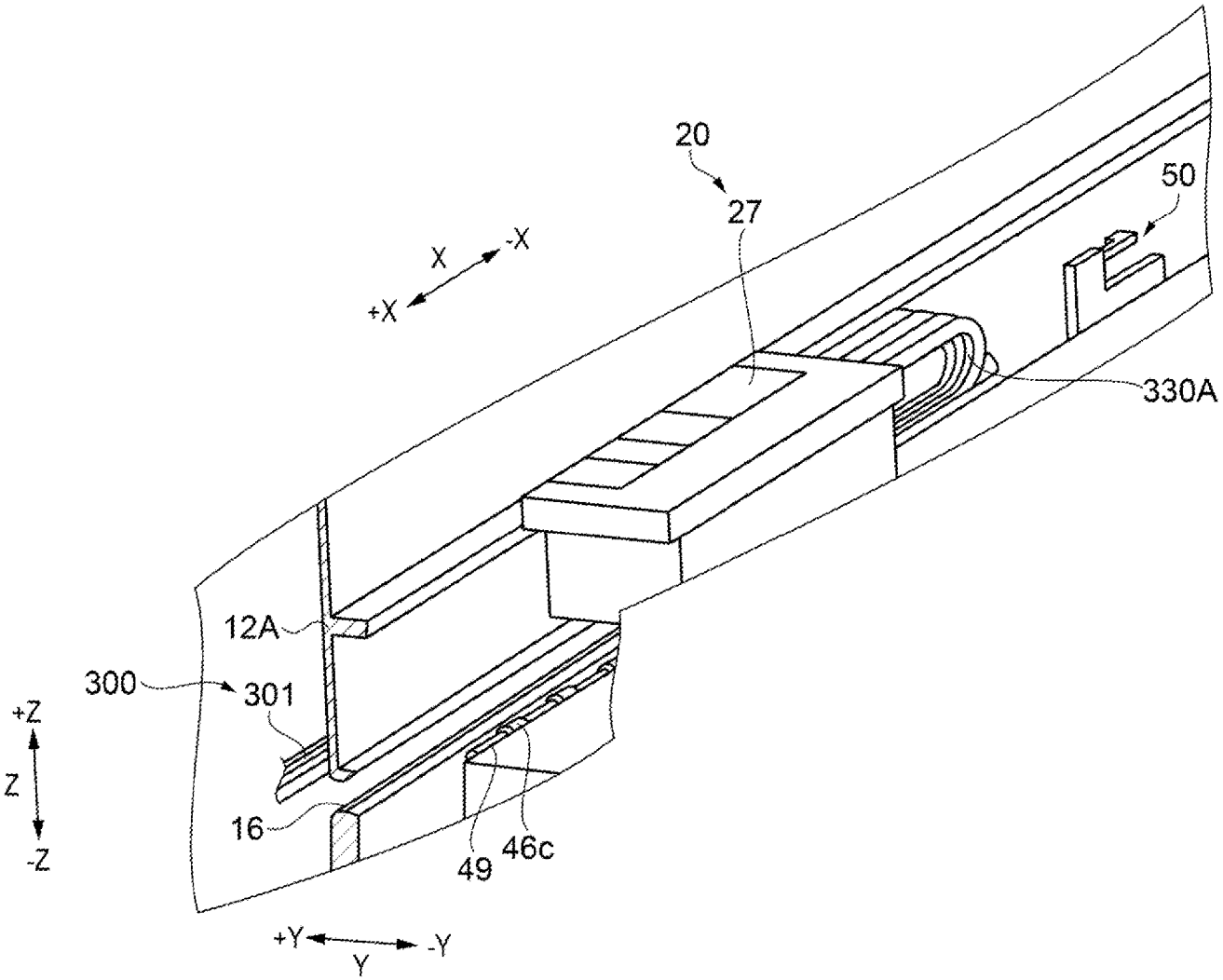
FIG. 7 is a partial perspective view illustrating an internal configuration of the inkjet printer according to the second embodiment.

Next, a second embodiment will be described. FIG. 5 is an outer perspective view illustrating a configuration of an inkjet printer 11A, and FIG. 6 is a lateral side view illustrating an internal configuration of the inkjet printer 11A. FIG. 7 is a partial perspective view illustrating the internal configuration of the inkjet printer 11A. The inkjet printer 11A of the embodiment includes an ink supply unit 10A. In the embodiment, a mode of routing the tube bundle 300 in the ink supply unit 10A will be mainly described. Note that a similar portion in the configuration of the inkjet printer 11A to that in the first embodiment will not be described.

As illustrated in FIG. 5 and FIG. 6, the ink supply unit 10A includes the ink tank 18 provided outside the housing 12 and configured to store ink, and the tube bundle 300 obtained by bundling a plurality of tubes 301 by which the ink storage unit 27 in the housing 12 and the ink tank 18 are coupled. Note that the ink tank 18, the tube 301, and the tube bundle 300 are configured in much the same way as those in the first embodiment, and thus, these will not be described.

As illustrated in FIG. 5, the four tubes 301 coupled to the ink tank 18 provided outside the housing 12 are configured as one tube bundle 300. The tube bundle 300 is inserted from the paper exit 16 into the housing 12. Here, the tube alignment direction of the tube bundle 300 at the paper exit 16 intersects with the sheet surface normal direction of the sheet P at the paper exit 16. Note that the tube alignment direction of the tube bundle 300 at the paper exit 16 is the same as that of the first embodiment, and thus, description thereof is omitted.

In addition, in the embodiment, the tank accommodating unit 19 accommodating the ink tank 18 is disposed on a front surface which is a side surface on the +Y direction side in the housing 12 and at the end in the +X direction of the front surface. Furthermore, the tank accommodating unit 19 is disposed at an upper portion of the front surface of the housing 12. That is, the ink tank 18 is disposed to protrude in the +Y direction with respect to the housing 12.

The tube bundle 300 is inserted from a position in the +Y direction relative to the paper exit 16 toward a central portion along the X axis of the paper exit 16. That is, when the inkjet printer 11A is viewed from the +Z direction, the tube bundle 300 is inserted obliquely relative to the paper exit 16.

Note that, similarly to the first embodiment, at the paper exit 16, the tube bundle 300 is disposed so that an end on the +Z direction side of the tubes 301 included in the tube bundle 300 and an end on the +Z direction side of the paper exit 16 come into contact with each other. In this way, a gap is formed between an end on the −Z direction side of the tube 301 and an end on the −Z direction side of the paper exit 16 to prevent interference between the sheet P and the tube 301, and as a result, it is possible to secure the transportability for the sheet P.

As illustrated in FIG. 6 and FIG. 7, the tube bundle 300 inserted into the housing 12 from the outside of the housing 12 via the paper exit 16 passes through a position where the driven roller 46*c* included in the fourth transport roller pair 44 is not present. Specifically, the driven roller 46*c* is configured by a star wheel and the like, and includes a plurality of driven rollers 46*c* arranged at predetermined intervals on the roller shaft 49 extending along the X axis. The tube bundle 300 passes between the adjacent driven rollers 46*c*, that is, a position where the driven roller 46*c* is not present. Thus, the tube bundle 300 inserted from the paper exit 16 can be easily inserted into the housing 12 without interfering with the driven roller 46*c*.

Note that the driven roller 46*b* corresponds to a first sheet ejecting roller, and the driven roller 46*c* corresponds to a second sheet ejecting roller.

Further, the tube bundle 300 inserted into the housing 12 passes between the driven roller 46*b* included in the third transport roller pair 43 and a frame 12A including the paper exit 16. The frame 12A is a wall configuring a front surface of the housing 12. Upward lifting of the sheet P transported by the driven rollers 46*b* and 46*c* is suppressed, and thus, the interference between the tube bundle 300 and the sheet P is prevented, the tube bundle 300 can be efficiently routed, and the sheet P can be smoothly transported.

Further, as illustrated in FIG. 7, the tube bundle 300 inserted from the paper exit 16 forms a curved portion 330A, which is a curved portion, in the housing 12, and is coupled to the ink storage unit 27 via the curved portion 330A. The curved portion 330A moves along with the movement of the carriage 20. Here, the tube alignment direction of the tube bundle 300 in the curved portion 330A intersects with the X axis, which is the movement direction of the carriage 20, and the sheet surface normal direction of the sheet P.

Here, as for the tube alignment direction of the tube bundle 300 at the curved portion 330A, if all the tubes 301 are present on a straight line linking centers of the two most distant tubes, in a cross section orthogonal to an extending direction of all the tubes 301 included in the tube bundle 300 in the curved portion 330A, the extension direction of the straight line is the tube alignment direction of the tube bundle 300. In the embodiment, the tube alignment direction of the tube bundle 300 at the curved portion 330A is a direction substantially along the Y axis, and intersects with the X axis, which is a scanning direction of the carriage 20, and the Z-axis, which is the sheet surface normal direction of the sheet P. In this way, it is possible to efficiently route the tube bundle 300 in a narrow space between the paper exit 16 and the carriage 20.

According to the present embodiments, the following advantages can be obtained.

The expansion of the space for routing the tube bundle 300 from the ink tank 18 provided outside the housing 12 into the housing 12 can be suppressed.

In addition, it is not necessary to widen the opening of the paper exit 16 when the tube bundle 300 is inserted from the paper exit 16, and thus, the opening area of the paper exit 16 is suppressed, and thus, it is possible to prevent a foreign material from entering from the paper exit 16 into the housing 12.

Moreover, when the curved portion 330A is formed in the tube bundle 300, it is possible to efficiently route the tube bundle 300 into a narrow space of the housing 12.

3. Modification Example

Modifications are described below.

Modification 1

Figure 8:
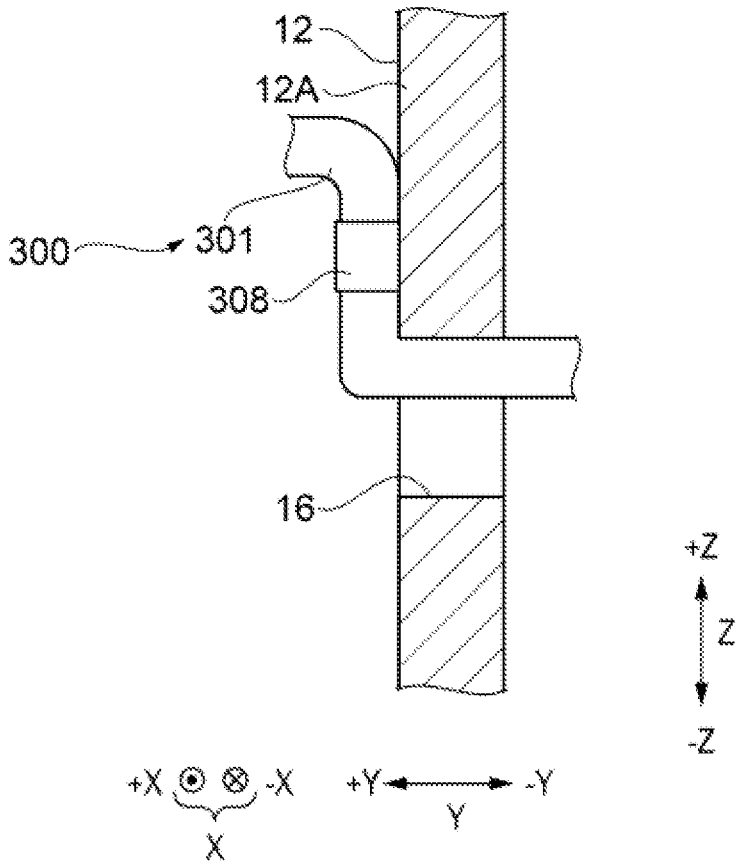
FIG. 8 is an external view illustrating a method of routing a tube bundle according to modification 1.

In the first embodiment, the tube bundle 300 is fixed inside the housing 12 of the frame 12A, but as illustrated in FIG. 8, the tube bundle 300 may be fixed outside the housing 12 of the frame 12A. In this case, a portion of the tube bundle 300 that is inserted into the paper exit 16 and is adjacent to the paper exit 16 is fixed to a surface outside the housing 12 of the frame 12A. More specifically, the tube bundle 300 is fixed with an adhesive tape 308 so that a near-side portion of the tube bundle 300 inserted into the paper exit 16 is positioned further in the +Z direction than the end in the +Z direction of the paper exit 16. This fixation can prevent the tube bundle 300 near the paper exit 16 from sagging in the −Z direction, and can suppress the interference between the tube bundle 300 and the sheet P.

Modification 2

Figure 9:
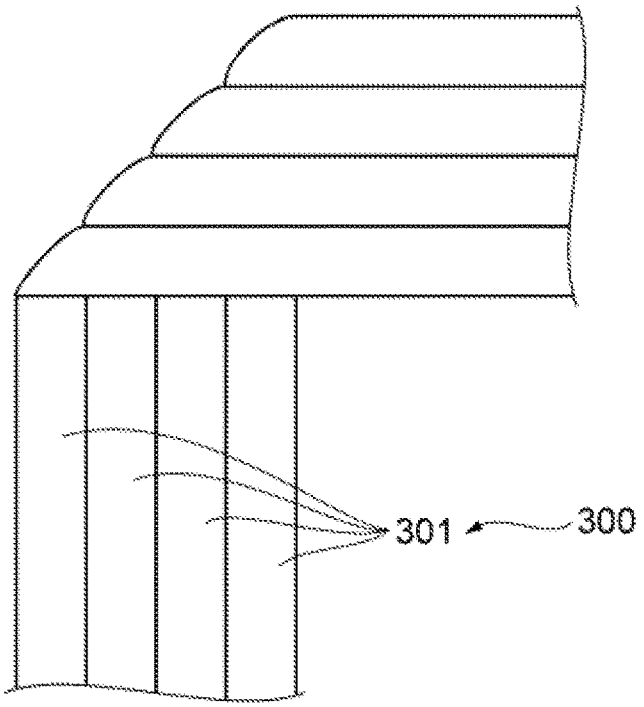
FIG. 9 is an external view illustrating a method of routing a tube bundle according to modification 2.

In the first embodiment, the tubes 301 are connected to one another via the first and second coupling portions 321 and 322, but the present disclosure is not limited to this configuration. As illustrated in FIG. 9, a configuration where a single tube 301 is folded may be possible. This configuration can eliminate the first and second coupling portions 321 and 322 and the like, and thus, cost can be reduced.

Modification 3

Figure 10:
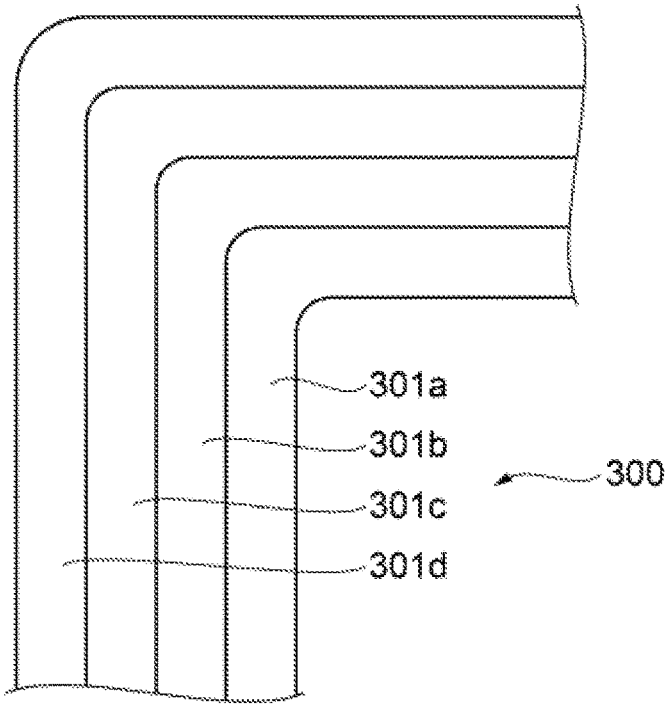
FIG. 10 is an external view illustrating a configuration of a tube bundle according to modification 3.

In the embodiments described above, lengths of the plurality of tubes 301 are approximately equal, but the present disclosure is not limited to this configuration. For example, as illustrated in FIG. 10, when the plurality of tubes 301 are bent and routed, an entire length of each of the tubes 301 may be increased in the order from a tube 301*a* arranged at the innermost circumference to a tube 301*d* arranged at the outermost circumference. In this way, it is possible to efficiently route the tube bundle 300 including the tubes 301*a*, 301*b*, 301*c*, and 301*d*.

Modification 4

In the second embodiment as well, similarly to the first embodiment, the tube bundle 300 may be fixed to the frame 12A. Further, the frame 12A may include a rib with which to support the tube bundle 300. In this way also, it is possible to prevent the tube bundle 300 from sagging.

Contents derived from the Embodiments will be described below.

An inkjet printer includes a housing, a first ink tank provided outside the housing, the first ink tank configured to store ink, a carriage having a second ink tank provided inside the housing, the second ink tank configured to store the ink, and a tube bundle obtained by bundling a plurality of tubes by which the second ink tank and the first ink tank are coupled, wherein the housing is provided with a paper exit through which a sheet in the housing passes, the tube bundle passes through the paper exit, and a tube alignment direction of the tube bundle at the paper exit intersects with a sheet surface normal direction of the sheet at the paper exit.

According to this configuration, the tube bundle couples the first ink tank and the second ink tank via the paper exit. If the paper exit through which the sheet passes is utilized as a routing path of the tube bundle, it is not necessary to additionally provide a routing path for the tube bundle in the housing. This reduces a limitation imposed on a position where the first ink tank is disposed. Accordingly, the space for routing the tube bundle from the first ink tank provided outside the housing into the housing can be suppressed from expanding. Furthermore, the tube bundle passes through the paper exit while intersecting with a sheet surface normal direction of the sheet at the paper exit. This eliminates a need to enlarge the paper exit in the sheet surface normal direction of the sheet at the paper exit, and thus, an opening area of the paper exit is suppressed, and it is possible to prevent a foreign material from entering from the paper exit into the interior of the housing.

It is preferred that in the inkjet printer described above, the tube bundle is curved in the housing, and the tube alignment direction of the tube bundle at a curved portion movable along with movement of the carriage intersects with a sheet surface of the sheet at the paper exit.

According to this configuration, it is possible to efficiently route the tube bundle in a narrow space between the paper exit and the carriage.

It is preferred that in the inkjet printer described above, the tube bundle is curved in the housing, and the tube alignment direction of the tube bundle of a curved portion movable along with movement of the carriage intersects with a scanning direction of the carriage and a sheet surface normal direction of the sheet.

According to this configuration, it is possible to efficiently route the tube bundle in a narrow space between the paper exit and the carriage.

It is preferred that the inkjet printer described above includes a cutting unit provided inside the housing, the cutting unit configured to cut the sheet, wherein the carriage includes an ejection unit configured to eject ink of the second ink tank onto the sheet, the cutting unit cuts the sheet, in a transport direction of the sheet, between the paper exit and the ejection unit, and a portion of the tube bundle on the second ink tank side from the paper exit is fixed to a frame of the housing in which the paper exit is provided.

According to this configuration, the tube bundle routed into the housing is fixed to the frame, so that it is possible to prevent the tube bundle from sagging. Thus, the interference between the tube bundle and the cutting unit can be suppressed.

It is preferred that the inkjet printer described above includes a sheet ejecting roller configured to contact a surface of the sheet onto which the ink is ejected, wherein the sheet ejecting roller is positioned, in a transport direction of the sheet, downstream from a position at which ink of the second ink tank is ejected onto the sheet and upstream from the paper exit, and the tube bundle passes between the sheet ejecting roller and the frame of the housing including the paper exit.

According to this configuration, it is possible to suppress the sheet transported by the sheet ejecting roller from lifting upward. As a result, interference between the tube bundle and the sheet is prevented, the tube bundle is efficiently routed, and the sheet can be smoothly transported.

It is preferred that the inkjet printer described above includes a sheet ejecting roller configured to contact a surface of the sheet onto which the ink is ejected, wherein the sheet ejecting roller is positioned, in the transport direction, downstream from a position at which ink of the second ink tank is ejected onto the sheet and upstream from the paper exit, and the tube bundle passes between the sheet ejecting roller and the frame.

According to this configuration, it is possible to suppress the sheet transported by the sheet ejecting roller from lifting upward. As a result, interference between the tube bundle and the sheet is prevented, the tube bundle is efficiently routed, and the sheet can be smoothly transported.

It is preferred that the inkjet printer described above includes a roller shaft positioned, in a transport direction of the sheet, downstream from a position at which ink of the second ink tank is ejected onto the sheet and upstream from the paper exit, and a sheet ejecting roller rotatably supported on the roller shaft, the sheet ejecting roller being configured to contact a surface of the sheet onto which the ink is ejected, wherein the tube bundle at the paper exit passes through a position where the sheet ejecting roller is not present in an extending direction of the roller shaft.

According to this configuration, the tube bundle is routed via a location where the sheet ejecting roller is not present. Accordingly, interference between the tube bundle and the sheet ejecting roller is prevented, and damage to the tube and the like can be reduced.

It is preferred that the inkjet printer described above includes a first sheet ejecting roller serving as the sheet ejecting roller, a roller shaft positioned, in the transport direction, downstream from the first sheet ejecting roller and upstream from the paper exit, and a second sheet ejecting roller rotatably supported on the roller shaft, the second sheet ejecting roller being configured to contact a surface of the sheet onto which the ink is ejected, wherein the tube bundle at the paper exit passes through a position where the second sheet ejecting roller is not present in an extending direction of the roller shaft.

According to this configuration, the tube bundle is routed via a location where the sheet ejecting roller is not present. Accordingly, interference between the tube bundle and the sheet ejecting roller is prevented, and damage to the tube and the like can be reduced.

An ink supply unit is an ink supply unit for supplying ink to a second ink tank of an inkjet printer including a housing, a carriage having the second ink tank provided inside the housing, and a paper exit provided in the housing, where a sheet in the housing passes through the paper exit. The ink supply unit includes a first ink tank provided outside the housing, the first ink tank configured to store ink, and a tube bundle obtained by bundling a plurality of tubes by which the second ink tank and the first ink tank are coupled, wherein the tube bundle passes through the paper exit, and a tube alignment direction of the tube bundle at the paper exit intersects with a sheet surface normal direction of the sheet at the paper exit.

In a configuration in which an ink supply unit is mounted in an inkjet printer, a tube bundle couples a first ink tank and a second ink tank via a paper exit. If the paper exit through which a sheet is passed is utilized as a routing path of the tube bundle, it is not necessary to additionally provide the routing path for the tube bundle in a housing. This reduces a limitation imposed on a position where the first ink tank is disposed. Accordingly, the space for routing the tube bundle from the first ink tank provided outside the housing into the housing can be suppressed from expanding. Furthermore, the tube bundle passes through the paper exit while intersecting with a sheet surface normal direction of the sheet at the paper exit. This eliminates a need to enlarge the paper exit in the sheet surface normal direction of the sheet at the paper exit, and thus, an opening area of the paper exit is suppressed, and it is possible to prevent a foreign material from entering from the paper exit into the interior of the housing.

What is claimed is:

1. An inkjet printer, comprising:

a housing;

a first ink tank provided outside the housing, the first ink tank being configured to store ink;

a carriage having a second ink tank provided inside the housing, the second ink tank being configured to store the ink; and a tube bundle obtained by bundling a plurality of tubes by which the second ink tank and the first ink tank are coupled, wherein the housing is provided with a paper exit through which a sheet in the housing passes, the tube bundle passes through the paper exit, and a tube alignment direction of the tube bundle at the paper exit intersects with a sheet surface normal direction of the sheet at the paper exit.

2. The inkjet printer according to claim 1, wherein the tube bundle is curved in the housing, and the tube alignment direction of the tube bundle at a curved portion movable along with movement of the carriage intersects with a sheet surface of the sheet at the paper exit.

3. The inkjet printer according to claim 1, wherein the tube bundle is curved in the housing, and the tube alignment direction of the tube bundle at a curved portion movable along with movement of the carriage intersects with a scanning direction of the carriage and the sheet surface normal direction of the sheet.

4. The inkjet printer according to claim 1, comprising:

a cutting unit provided inside the housing, the cutting unit being configured to cut the sheet, wherein the carriage includes an ejection unit configured to eject ink of the second ink tank onto the sheet, the cutting unit cuts the sheet, in a transport direction of the sheet, between the paper exit and the ejection unit, and a portion of the tube bundle on a side of the second ink tank from the paper exit is fixed to a frame of the housing in which the paper exit is provided.

5. The inkjet printer according to claim 1, comprising:

a sheet ejecting roller configured to contact a surface of the sheet onto which the ink is ejected, wherein the sheet ejecting roller is positioned, in a transport direction of the sheet, downstream from a position at which ink of the second ink tank is ejected onto the sheet and upstream from the paper exit, and the tube bundle passes between the sheet ejecting roller and the frame of the housing including the paper exit.

6. The inkjet printer according to claim 4, comprising:

a sheet ejecting roller configured to contact a surface of the sheet onto which the ink is ejected, wherein the sheet ejecting roller is positioned, in the transport direction, downstream from a position at which ink of the second ink tank is ejected onto the sheet and upstream from the paper exit, and the tube bundle passes between the sheet ejecting roller and the frame.

7. The inkjet printer according to claim 1, comprising:

a roller shaft positioned, in a transport direction of the sheet, downstream from a position at which ink of the second ink tank is ejected onto the sheet and upstream of the paper exit; and a sheet ejecting roller rotatably supported on the roller shaft, the sheet ejecting roller being configured to contact a surface of the sheet onto which the ink is ejected, wherein the tube bundle at the paper exit passes through a position, in an extending direction of the roller shaft, where the sheet ejecting roller is not present.

8. The inkjet printer according to claim 5, comprising:

a first sheet ejecting roller serving as the sheet ejecting roller;

a roller shaft positioned, in the transport direction, downstream of the first sheet ejecting roller and upstream of the paper exit; and a second sheet ejecting roller rotatably supported on the roller shaft, the second sheet ejecting roller being configured to contact a surface of the sheet onto which the ink is ejected, wherein the tube bundle at the paper exit passes through a position where the second sheet ejecting roller is not present in an extending direction of the roller shaft.

9. An ink supply unit for supplying ink to a second ink tank of an inkjet printer including a housing, a carriage having the second ink tank provided inside the housing, and a paper exit through which a sheet in the housing passes, the paper exit being provided in the housing, the ink supply unit comprising:

a first ink tank provided outside the housing, the first ink tank being configured to store ink; and a tube bundle obtained by bundling a plurality of tubes by which the second ink tank and the first ink tank are coupled, wherein the tube bundle passes through the paper exit, and a tube alignment direction of the tube bundle at the paper exit intersects with a sheet surface normal direction of the sheet at the paper exit.

* * * * *